US010477932B2

(12) United States Patent
Bouganim et al.

(10) Patent No.: US 10,477,932 B2
(45) Date of Patent: Nov. 19, 2019

(54) PORTABLE SECURE CARRIER ARRANGEMENT

(71) Applicants: Alexander Bouganim, New York, NY (US); Samantha Bouganim, New York, NY (US)

(72) Inventors: Alexander Bouganim, New York, NY (US); Samantha Bouganim, New York, NY (US)

( * ) Notice: Subject to any disclaimer, the term of this patent is extended or adjusted under 35 U.S.C. 154(b) by 0 days.

(21) Appl. No.: 15/879,632

(22) Filed: Jan. 25, 2018

(65) Prior Publication Data

US 2018/0146754 A1 May 31, 2018

Related U.S. Application Data

(62) Division of application No. 15/670,252, filed on Aug. 7, 2017, now Pat. No. 9,918,530.

(60) Provisional application No. 62/376,446, filed on Aug. 18, 2016.

(51) Int. Cl.

| | |
|---|---|
| ***A45C 1/04*** | (2006.01) |
| ***A45C 11/16*** | (2006.01) |
| ***A45C 13/10*** | (2006.01) |
| ***A45C 13/00*** | (2006.01) |
| *A45F 5/00* | (2006.01) |

(52) U.S. Cl.

CPC ..... *A45C 1/04* (2013.01); *A45C 11/16* (2013.01); *A45C 13/002* (2013.01); *A45C 13/10* (2013.01); *A45F 2005/008* (2013.01)

(58) Field of Classification Search

CPC ..... A45C 11/16; A45C 5/003; A45C 9/0084; A45C 9/0092; A45C 19/00; A45C 1/04; A45C 2013/303; A45C 13/002; A45C 13/10; A45F 2005/008; A45F 2200/0541; A45F 2200/055; A45F 5/022; A47F 7/02

USPC ..... 206/6.1, 566; 224/644, 630, 165, 224/217–222; 211/85.2

See application file for complete search history.

(56) References Cited

U.S. PATENT DOCUMENTS

| | | | | |
|---|---|---|---|---|
| 1,486,178 | A * | 3/1924 | Antelmi | A45C 11/22 224/221 |
| 1,486,629 | A * | 3/1924 | Buchsbaum | A45C 11/16 206/751 |
| 1,573,239 | A * | 2/1926 | Gilliland | B65D 81/18 206/0.81 |
| D423,723 | S * | 4/2000 | Metcalf | D28/77 |
| 7,673,744 | B1 * | 3/2010 | Henderson | A45C 11/16 206/473 |
| 2005/0242137 | A1 * | 11/2005 | Fishman | A01K 11/00 224/221 |
| 2008/0135422 | A1 * | 6/2008 | Martinez | A47F 7/02 206/6.1 |

* cited by examiner

*Primary Examiner* — Scott T McNurlen
(74) *Attorney, Agent, or Firm* — Lawrence G. Fridman, Esq.; Feigin & Fridman, LLC

(57) ABSTRACT

A secure personal wearable carrier for valuable items is disclosed. The wearable carrier includes a secure compartment for valuable item storage to be worn by users during their common activities, including physical exercises. The carrier is constructed to maintain the security and safety of the valuable item while withstanding strenuous activity.

7 Claims, 4 Drawing Sheets

PORTABLE SECURE CARRIER ARRANGEMENT

CROSS REFERENCE TO RELATED APPLICATIONS

This application is a Divisional Application of currently pending U.S. patent application Ser. No. 15/670,252 filed Aug. 7, 2017, which claims the benefit of U.S. Provisional Patent Application Ser. No. 62/376,446, filed Aug. 18, 2016; the disclosures of which are incorporated herein by reference in their entireties.

FIELD OF THE INVENTION

The present invention relates generally to a carrier for valuable items, and more particularly to portable secure carrier arrangements, which can be worn by users during their common activities, including physical exercises.

BACKGROUND OF THE INVENTION

Wearing valuable items, such as jewelry by many individuals during common activities is well known. Due to the high cost of jewelry and proliferation of physical exercises many individuals in general, and female athletes in particular, are often exposed to uneasy choices about what to do with such valuables during sometime vigorous physical routines. For such individuals, it is not uncommon to occasionally find themselves in situations where safekeeping and storage facilities are not readily available. For example, female athletes often train or exercise in sport facilities such as gyms, athletic clubs, etc. that do not offer secure places to store small valuable personal items, including jewelry. Moreover, traditional workout clothing rarely, if ever, has secure pockets that accommodate valuable small items, such as jewelry, including rings.

Accordingly, there has been a long felt and unsolved need for a lightweight, unobtrusive secure and effective carrier or storage arrangement for valuable items or jewelry which can be worn by a user during everyday activities. There is also a further need for such a carrier arrangement which can be used by a common person in a simple and effortless manner with little or no training.

Efforts have been previously made to attempt to solve the issue of storing personal valuables during activities. Prior art such as those shown in Roegner, U.S. Pat. No. 6,227,424 and Rogers, U.S. Pat. Pub. No. 2004/0206791 attempt to resolve secure storage issues, but fail to provide a compact and sleek design with a fully secure storage component. Rather, their disclosure provides for a large cumbersome pouch arrangement, without the security and ease of use provided by the present invention. Similarly, the prior art personal storage devices detailed in Mazzo, U.S. Pat. No. 5,755,366, Carter, U.S. Pat. No. D371,675 and Law, U.S. Pat. No. D442,365 lack the sleek compact and secure design provided by the present invention.

The present invention provides a useful, novel and unique personal storage arrangement that is aesthetically-pleasing, secure, lightweight and comfortable for the user to wear while performing varied high stress tasks. These attributes of the present invention are not found in the prior art devices.

SUMMARY OF THE INVENTION

For purposes of this description, the terms "upper," "bottom," "right," "left," "front," "vertical," "horizontal," and derivatives thereof shall relate to the invention as oriented in figures of the drawing.

As to a further description of the manner and use of the different embodiments of the present invention, the same should be apparent from the above description. Accordingly, no further discussion relating to the manner of usage and operation of the embodiments different from that discussed below will be provided.

The terminology used herein is for the purpose of describing particular embodiments only and is not intended to be limiting of the invention. As used herein, the singular foil is "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

In general terms, the invention disclosed is a personal wearable carrier for valuable items, and more particularly portable secure carrier arrangements which can be worn by users during their common activities, including physical exercises. This invention provides a unique, lightweight, wearable and aesthetically-pleasing storage arrangement that securely and secretively holds valuables such as rings or other small pieces of jewelry or other valuables. The invention is comfortable to wear and withstands impacts from physical activity without dislodging the secured storage container or fastening mechanism which forms the secure construct.

The present invention includes two embodiments. The first embodiment having a housing interconnected with two strap members is configured to securely house a storage container for small valuables within the receiving compartment's operational space. This design is lightweight, durable, and optimally designed to be affixed to a wrist or ankle. The storage container is secured within the receiving cavity by a closure cap which provides a sealed enclosure.

The second embodiment includes a housing configured to interconnect with two strap members. The housing includes a receiving compartment with a conical securement portion adjacent to the base that securely holds small valuables held in place by a cushioned overlay. The arrangement is fully secured by the closure cap.

It is an object of the present invention to provide a wearable secure carrier arrangement that holds small valuables.

It is another object of the present invention to securely store small valuables and protect them from damage during periods of high activity.

It is yet another object of the present invention to have adjustable straps that provide a comfortable user fit.

It is a feature of the present invention that the carrier arrangement is lightweight and aesthetically-pleasing.

It is another feature of the present invention that the carrier arrangement is sleek and practical in size to not impair the user during periods of high activity.

BRIEF DESCRIPTION OF THE DRAWINGS

Referring now to the drawings which are provided to illustrate and not to limit the invention, wherein.

DETAILED DESCRIPTION OF THE INVENTION

Figure 1:
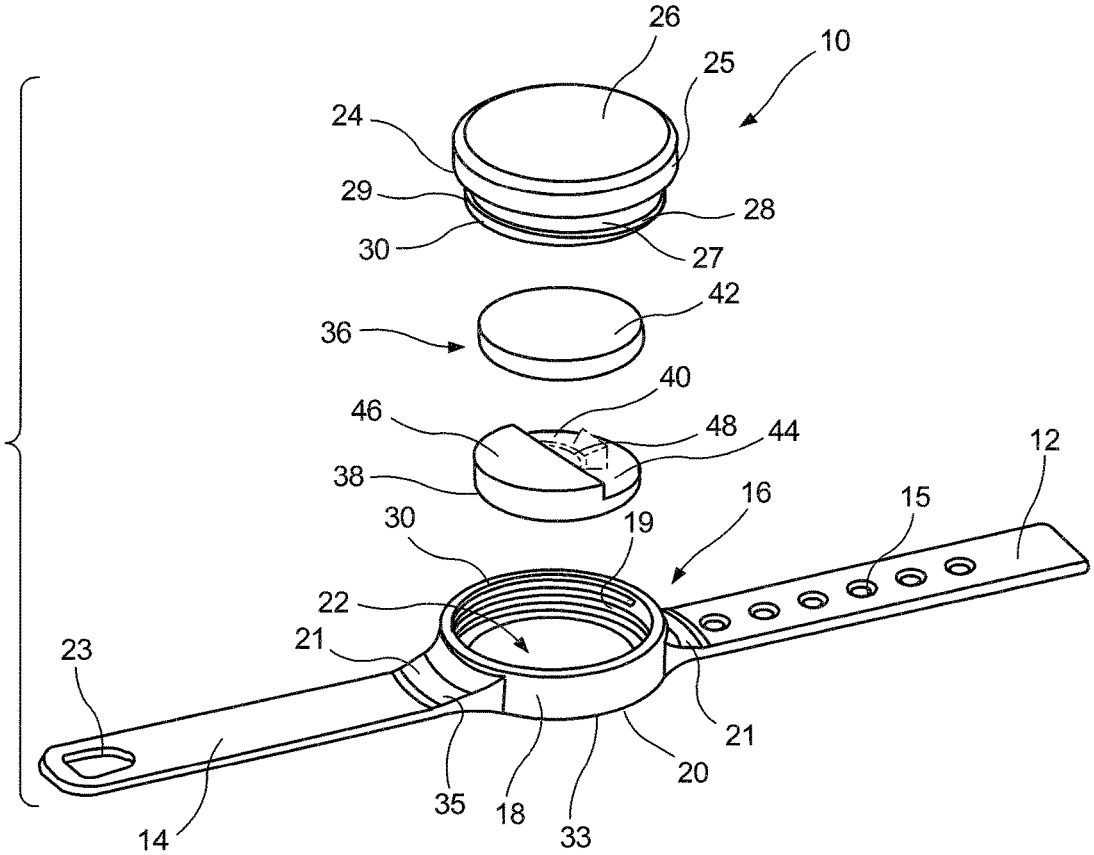
FIG. 1 is an exploded view showing a secure carrier of the invention.
Figure 2:
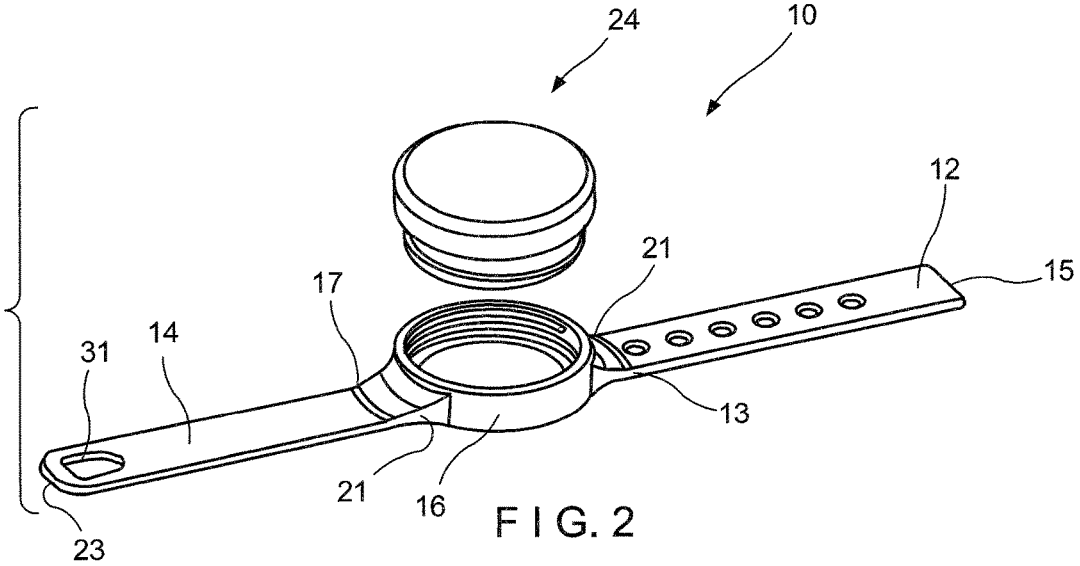
FIG. 2 is another exploded view illustrating the secure carrier of the invention.

With reference now to the drawings in general, and in particular to FIGS. 1 and 2, a new strap-on security carrier arrangement is provided embodying the principles and concepts of the present invention and generally designated by the reference numeral 10 will be described. As best illustrated in FIG. 1, the strap-on security carrier arrangement 10 generally comprises a plurality of strap members 12, 14 for fastening about a wrist of a user, and also comprises a housing 16 having at least a cylindrical peripheral wall 18 and a bottom wall 20. Exterior of the illustrated housing is preferably, although not necessarily, round so as to be approximately the size of an ordinary wrist watch.

A receiving cavity 22 adapted to receive a storage container 36 is formed between the cylindrical peripheral wall or peripheral wall 18 and the bottom wall 20. The peripheral wall 18 has an interior surface 19 with fastening means 30 thereon. A closure cap 24 with a solid upper wall 26 and a side cylindrical wall 28 formed with a fastening means 30 is provided to close the receiving cavity 22 after positioning the storage container 36 there inside. The closure cap 24 is configured to fit over the top opening of the housing. The closure cap 24 has a top portion 25 adjacent to the upper wall 26 and a lower portion 27 adjacent to the top portion 25. The lower portion 27 is offset from the top portion 25 and includes fastening means 30 on the lower portion 27 exterior surface 29 for secured interconnection with the cylindrical peripheral wall 18 interior surface 19 fastening means 30.

As illustrated in FIG. 1, in the preferred embodiment the fastening means 30 in the form of a treatable engagement between treads provided at an exterior surface 29 of the side cylindrical wall 28 and an inner surface 19 of the peripheral wall 18. In the assembled condition, after being positioned within the receiving cavity 22, the storage container 36 is securely disposed between the bottom wall 20 of the housing and the upper wall 26 of the closure cap 24. On the other hand, it is understood that any conventional form of the fastening means assuring a secure connection between the housing 16 and the closure cap 24 is within the scope of the invention.

To minimize weight of the carrier 10, the housing 16 can be formed without the solid bottom wall 20, so that the central opening extends through the entire housing 16. In this alternate embodiment (not illustrated) a circumferential shoulder or a ledge extending inwardly from the bottom area of the central opening can be formed. In the assembled condition of this embodiment the storage container is supported from the bottom by the circumferential shoulder, extends within the central opening of the housing and is secured from the top by the closure cap 24.

As illustrated in FIG. 1, the storage container 36 is formed with a base 38 having a receiving compartment 40 and a top portion 42. The receiving compartment 40 is defined by a solid base wall 44 having a disc shaped configuration and a partial top wall 46 separated from the base wall by an operational space 48. The base wall 44 and partial top wall 46 are interconnected by a partial side wall. In the illustrated embodiment the top wall 46 corresponds to approximately a half of the area of the base wall 44. In use the item to be stored (a ring for example, as shown in FIG. 1) is positioned on a top surface of the base 38, so that at least a part of a shank is disposed within the operational space 48 also to be protected by the partial top wall 46. It should be noted however, that the above is just one example of how the storage container is used. In this respect, any application of the storage container and the operational space adapted to accommodate any part of the stored item (piece of jewelry) is within the scope of the invention.

In use, the storage container 36 (adapted to receive and securely retain small valuable items such as jewelry, including rings, etc.) is disposed in the receiving cavity 22 and is accessible through the top opening of the housing 16. The storage container remains in its secure position within the receiving cavity, while permitting easy removal as desired when the container with valuables has to be removed or its use discontinued. On the other hand, an embodiment of the invention where the storage container or at least the base 38 remains permanently within the receiving cavity is also contemplated.

The housing 16 may include means for attaching the same to the strap members 12, 14 including bracket members 21 integrally extending outwardly from its outer periphery. The bracket members 21 each include an aperture 35 for receipt of the base ends 13, 17 of the straps 12, 14. In the illustrated embodiment, the wrist straps 12, 14 are provided to strap the housing 16 to the wrist of a user. The first strap 12 has a base end 13 and a distal end 15 with the base end 13 coupled to the bracket member 21 of the housing 16. The first strap 12 has a plurality of apertures 15 therein. The second strap 14 has a base end 17 and a distal end 23 with the base end 17 coupled to the bracket member 21. The first strap 12 is orientated generally opposed to the second strap 14. The second strap 14 has a strap connector illustrated in the form of buckle or fastening means 31 thereon for selectively coupling with the apertures 15 in the first strap 12. On the other hand, the straps can be adjustably connected by any number of conventional devices capable of securing the straps together in a removable manner. Several examples include opposing strips of hook and loop material (i.e. Velcro), magnetic elements, and compression fittings such as snaps and buttons which can be permanently secured to each end of the straps by a permanent sealer such as glue, adhesive or stitching.

An exterior or outer surface 33 of the bottom wall 20 of the housing is configured to make contact with the wrist of a user. The straps are preferably constructed from a material having good elastic characteristics and configured to stretch or to be disposed around the appendage of the user to which it is ultimately attached. The resilient quality of elastic materials will thus allow the straps to be worn without exhibiting signs of continued wear.

Although straps 12, 14 have been described above, the security carrier of the invention with a wrist band of any suitable type and material which is adapted to fit over the hand and remain in position on the wrist of the wearer is contemplated by the invention. Furthermore, the security carrier device of the present invention has been described above for wearing on a wrist of the user. However, applications of the device to other parts of human body are also contemplated. For example, the carrier including the straps can be worn over an ankle of the wearer's foot.

The housing assembly is typically molded of a deformable plastic. Suitable plastic having the desired elasticity and resiliency, and being sufficiently rigid is polypropylene, polyvinyl chloride, polyethylene, etc. The term plastic has been used herein to indicate the fact that a variety of materials such as natural or synthetic elastic and resilient plastic like materials can be utilized.

The advantage of using inexpensive materials, such as various plastics is that the secure carrier arrangement of the invention can be manufactured at a price enabling the arrangement to be distributed or sold as a disposable unit. The disposable aspect of the invention not only provides convenience of modern life, but also can facilitate its use in many commercial situations such as hotels, resorts, various sport facilities, as well as to be used in medical institutional environments, when a patient goes through various tests and procedures.

The description which follows is of a second embodiment of the strap-on security carrier arrangement. For ease of comprehension, where similar parts are shown, reference designators "100" units higher than those previously employed are used. Thus, the housing 116 of the second embodiment is analogous to the housing 16 of the first embodiment. Referring now to FIGS. 3 to 6, the second embodiment of the strap-on security carrier arrangement is referred to generally by the numeral 110.

Figure 3:
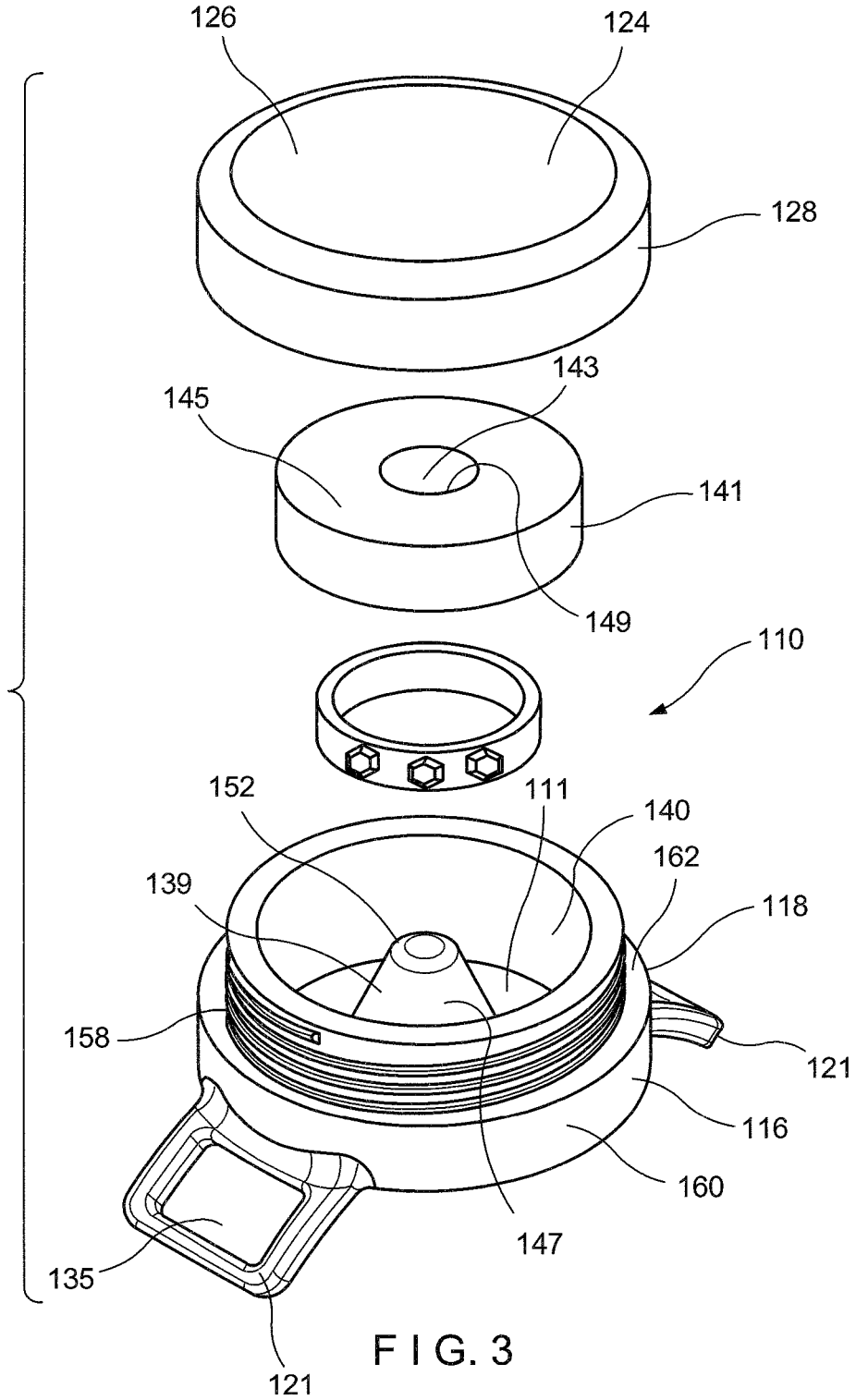
FIG. 3 is an exploded view showing an alternative design of the secure carrier of this invention.
Figure 4:
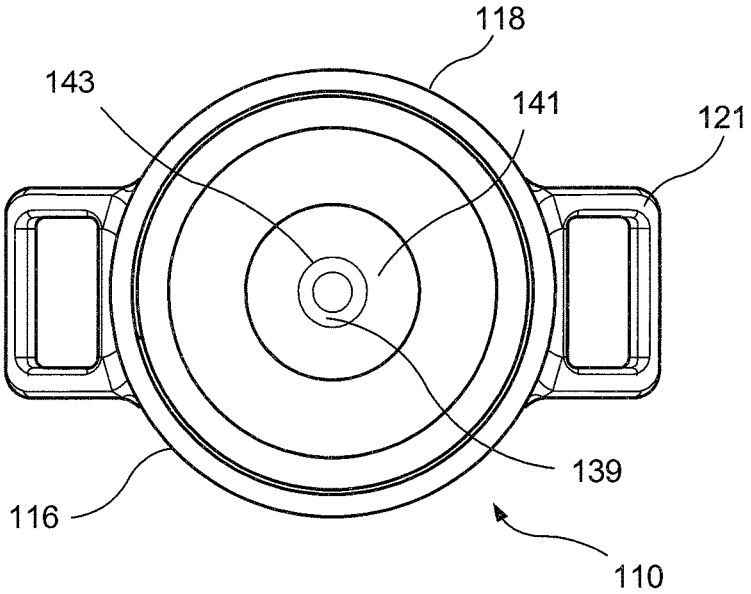
FIG. 4 is a top plan view of the secure carrier of FIG. 3.

With reference now to the drawings in general, and in particular to FIGS. 3 through 6, a new strap-on security carrier arrangement is provided embodying the principles and concepts of the present invention and generally designated by the reference numeral 110 will be described. As best illustrated in FIG. 3, the strap-on security carrier arrangement 110 generally comprises two strap members 12, 14 (as shown on FIG. 2) for fastening about a wrist of a user, and also comprises a housing 116 having at least a cylindrical peripheral wall 118 and a bottom wall 120. Exterior of the illustrated housing is preferably, although not necessarily, round so as to be approximately the size of an ordinary wrist watch.

Figure 5:
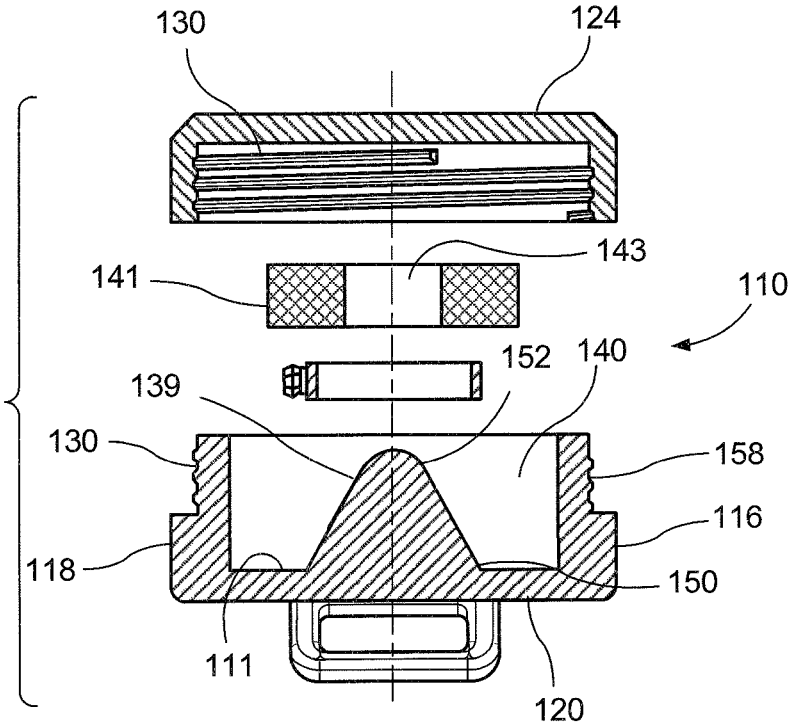
FIG. 5 is an exploded cross-sectional side view of the secure carrier of FIG. 3; and, FIG. 6 is a cross-sectional side view of the secure carrier of FIG. 3 in the assembled condition having a ring stored therewithin.
Figure 6:
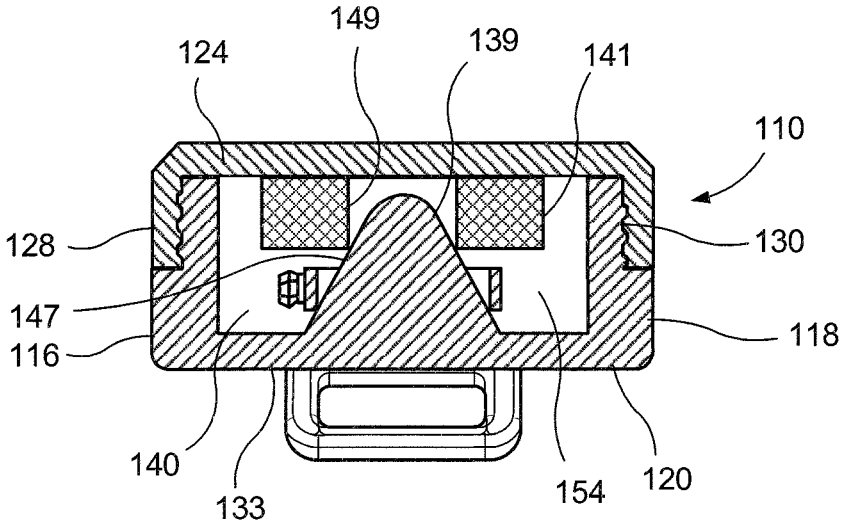

The bottom wall 120 and the cylindrical peripheral wall 118 form a receiving compartment 140 having a conical securement portion 139 affixed to or extended from the interior surface 111 of the bottom wall 120. The conical securement portion 139 is designed to receive a ring or other small item(s) of value as shown in FIGS. 3, 5 and 6. The conical securement portion 139 has an exterior surface 147, base end 150 affixed to or formed from the bottom wall 120 and a distal end 152 set opposite the base end 150. In the assembled condition, after the item(s) are positioned within the receiving compartment 140 on top of the conical securement portion 139, a cushioned overlay 141 is interconnected with the conical securement portion 139 through and within the storage cushioned overlay aperture 143 to create a secure compartment 154 to cradle the item(s), restrict movement of the item(s), and prevent damage to the item(s).

The cushioned overlay 141 is generally ring-shaped and constructed of materials such as rubber, sponge, neoprene and similar. The cushioned overlay 141 has an exterior surface 145 configured to fit within the receiving compartment 140 and encase the item(s). The exterior surface 145 has an aperture 143 therethrough forming an interior surface 149. When placed in the secured carrier arrangement 110, the exterior surface 145 is adjacent to the item and secured by the closure cap 124. The cushioned overlay exterior surface 145 encases and provides cushioned securement of the items in the receiving compartment 140. The cushioned overlay 141 interior surface 149 is placed over the conical securement portion distal end 152 and is engaged and stabilized on the exterior conical securement surface 147. The securement of the cushioned overlay 141 on the exterior conical securement surface 147 forms a secure space within said receiving cavity. The cushioned overlay 141 rests atop the exterior conical securement portion surface 147. The creation of the secure space 154 is shown in FIG. 6. It should be noted however, that the above is just one example of how the secure space 154 is created and used. In this respect, any application of the creation of the secure space 154 adapted to accommodate any part of the stored item(s) (piece of jewelry) is within the scope of the invention.

The closure cap 124 is secured to the housing 116 and rests atop the cushioned overlay 141 to maintain the secure space 154 that restricts movement of the item(s) without causing damage. The housing 116 cylindrical peripheral wall 118 is configured to receive and securely interconnect with the side cylindrical wall 128 of the closure cap 124 through fastening means 130 in the form of a treatable engagement between treads provided at an interior surface 156 of the side cylindrical wall 128 and an outer or exterior surface 158 of the peripheral wall 118. The peripheral wall 118 includes a lower wall 160 adjacent to the bottom wall 120 and an upper wall 162 adjacent to the lower wall 160. The upper wall 162 is offset from the lower wall 160 and has an exterior surface 158 with fastening means 130 thereon for secure interconnection with the closure cap 124 side cylindrical wall 128 interior surface 156 fastening means 130. On the other hand, it is understood that any conventional form of the fastening means assuring a secure connection between the housing 116 and the closure cap 124 is within the scope of the invention.

The closure cap 124 further includes an upper wall 126 to firmly secure the inserted valuable item(s) and prevent same from being ejected from the receiving compartment 140. The closure cap 124 is configured to fit over the top opening of the housing 116. As illustrated in FIG. 6, the fastening means 130 in the form of a treatable engagement between treads provided at an interior surface 156 of the side cylindrical wall 128 and an exterior 158 surface of the peripheral wall 118. In the assembled condition, after being positioned within the receiving compartment 140, the item(s) is securely disposed within the housing 116.

To minimize weight the carrier housing 116 can be formed without the solid bottom wall 120. Alternatively, the bottom wall 120 is constructed through a series of beams, cross-sectional arrangements or other means to interconnect the conical securement portion 139 to the cylindrical peripheral wall 118 so that the conical securement portion 139 is securely affixed to the cylindrical peripheral wall 118 of the housing 116 with the use of less materials (not illustrated).

The housing 116 may include means for attaching the same to the strap members 12, 14 including bracket members 121 integrally extending outwardly from its outer periphery. The bracket members 121 each include an aperture 135 for receipt of the base ends 13, 17 of the straps 12, 14. Wrist straps 12, 14 (as shown in FIG. 1) are provided to strap the housing 116 to the wrist of a user. The first strap 12 has a base end 13 and a distal end 15 with the base end 13 coupled to the bracket member 121 of the housing 116. The first strap 12 has a plurality of apertures 15 therein. The second strap 14 has a base end 17 and a distal end 13 with the base end 17 coupled to the bracket member 121. The first strap 12 is orientated generally opposed to the second strap 14. The second strap 14 has a strap connector illustrated in the form of buckle or fastening means 31 thereon for selectively coupling with the apertures 15 in the first strap 12. On the other hand, the straps can be adjustably connected by any number of conventional devices capable of securing the straps together in a removable manner. Several examples include opposing strips of hook and loop material (i.e. Velcro), magnetic elements, and compression fittings such as snaps and buttons which can be permanently secured to each end of the straps by a permanent sealer such as glue, adhesive or stitching.

An exterior or outer surface 133 of the bottom wall 150 of the housing 116 is configured to make contact with the wrist of a user. The straps 12, 14 are preferably be constructed from a material having good elastic characteristics and configured to stretch or to be disposed around the appendage of the user to which it is ultimately attached. The resilient quality of elastic materials will thus allow the straps to be worn without exhibiting signs of continued wear.

Although straps 12, 14 have been described above, the security carrier of the invention with a wrist band of any suitable type and material which is adapted to fit over the hand and remain in position on the wrist of the wearer is contemplated by the invention. Furthermore, the security carrier device of the present invention has been described above for wearing on a wrist of the user. However, applications of the device to other parts of human body are also contemplated. For example, the carrier including the straps can be worn over an ankle of the wearer's foot.

The housing assembly is typically molded of a deformable plastic. Suitable plastic having the desired elasticity and resiliency, and being sufficiently rigid is polypropylene, polyvinyl chloride, polyethylene, etc. The term plastic has been used herein to indicate the fact that a variety of materials such as natural or synthetic elastic and resilient plastic like materials can be utilized.

The advantage of using inexpensive materials, such as various plastics is that the secure carrier arrangement of the invention can be manufactured at a price enabling the arrangement to be distributed or sold as a disposable unit. The disposable aspect of the invention not only provides convenience of modern life, but also can facilitate its use in many commercial situations such as hotels, resorts, various sport facilities, as well as to be used in medical institutional environments, when a patient goes through various tests and procedures.

It has been described above that the present invention provides a lightweight, unobtrusive secure carrier arrangement that can be comfortably worn by a user during various common activities. The carrier arrangement of the invention is very economical and can be used by a common person in a simple and effortless manner with little or no training.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

What is claimed is:

1. A secure carrier arrangement, comprising:

a bottomless cylindrical housing having a cylindrical peripheral wall defining a central opening passing through the housing, a first fastening element provided on an inner surface of the peripheral wall, said cylindrical peripheral wall provided at a shoulder disposed perpendicular thereto and extending radially inwardly from said cylindrical peripheral wall, said central opening terminating at the shoulder, such that a receiving cavity is formed by said cylindrical peripheral wall and said shoulder;

a first strap member having a base end and a distal end;

a second strap member having a base end and a distal end;

a storage container including:

a base including a first portion having a first thickness and a second portion having a second thickness smaller than said first thickness such that a step formation is defined between said first portion and said second portion, an article receiving cavity is formed at an interface between said first and second portions having an access portal within said step formation, and a top portion, wherein, in use an article to be stored is inserted into said article receiving cavity via said access portal within said step formation, such that a portion of the article extends outwardly from said first portion, and another portion of the article, disposed within said article receiving cavity, is concealed within said cavity by said first portion, and wherein said storage container is devoid of fastening mechanisms; and a closure cap having a circular upper wall and a side cylindrical wall affixed to said circular upper wall, said side cylindrical wall having a second fastening element configured to securely interconnect with said first fastening element, said closure cap configured to encase said storage container, whereby upon placement of the storage container within the receiving cavity and under the closure cap, the second fastening element of the closure cap securely interconnects with said first fastening element of said cylindrical peripheral wall and the storage container is secured within the receiving cavity, and whereby, upon positioning of said secure carrier arrangement on the body of a user, said base of said storage container due to the bottomless formation of the housing is disposed against the body of the user.

2. A secure carrier arrangement as described in claim 1, wherein said secure carrier arrangement is constructed from at least one material selected from the group consisting of polypropylene, polyvinyl chloride, and polyethylene.

3. A secure carrier arrangement as described in claim 1, wherein an exterior surface of said base member of said housing is configured to make a contact with a wrist of a user through said bottomless formation of the housing.

4. A secure carrier arrangement as described in claim 1, wherein said first strap and said second strap are constructed from a material having elastic characteristics and configured for disposition on a wrist.

5. A secure carrier arrangement as described in claim 1, wherein said first strap member has a series of apertures, and said second strap member has a fastening element, said series of apertures adapted for interconnection with said fastening element of said second strap member.

6. A secure carrier arrangement as described in claim 5, wherein said fastening element of said second strap member is a buckle.

7. A secure carrier arrangement as described in claim 1, further comprising two bracket members affixed to the cylindrical peripheral walls set opposite the one to the other, said two bracket members each having an aperture therethrough and each configured for interconnection with the first strap member base end and the second strap member base end.

* * * * *